US008594922B1

(12) United States Patent
Simmons et al.

(10) Patent No.: US 8,594,922 B1
(45) Date of Patent: Nov. 26, 2013

(54) METHOD AND APPARATUS FOR DETERMINING A POSITION OF A HANDHELD IMAGE TRANSLATION DEVICE OVER A MEDIUM WHILE USING THE HANDHELD IMAGE TRANSLATION DEVICE TO TRANSLATE AN IMAGE ONTO THE MEDIUM

(71) Applicant: Marvell International Ltd., Hamilton (BM)

(72) Inventors: Asher Simmons, Corvallis, OR (US); James Mealy, Corvallis, OR (US); James D. Bledsoe, Corvallis, OR (US)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 13/789,451

(22) Filed: Mar. 7, 2013

Related U.S. Application Data

(63) Continuation of application No. 12/016,833, filed on Jan. 18, 2008, now Pat. No. 8,396,654.

(60) Provisional application No. 60/885,481, filed on Jan. 18, 2007.

(51) Int. Cl.
*B41J 2/15* (2006.01)

(52) U.S. Cl.
USPC ..... 701/408; 701/425; 359/197.1; 359/198.1; 347/5; 347/14; 347/20; 347/109

(58) Field of Classification Search
USPC ..... 701/408; 347/5, 14, 20
See application file for complete search history.

(56) References Cited

U.S. PATENT DOCUMENTS

| | | | |
|---|---|---|---|
| 4,347,511 | A | 8/1982 | Hofmann et al. |
| 5,278,582 | A | 1/1994 | Hongo |
| 5,387,976 | A | 2/1995 | Lesniak |
| 5,461,680 | A | 10/1995 | Davis |
| 5,578,813 | A | 11/1996 | Allen et al. |
| 5,927,872 | A | 7/1999 | Yamada |
| 5,930,466 | A | 7/1999 | Rademacher |
| 5,988,900 | A | 11/1999 | Bobry |
| 6,348,978 | B1 | 2/2002 | Blumer et al. |
| 6,384,921 | B1 | 5/2002 | Saijo et al. |
| 6,859,338 | B2 * | 2/2005 | Johnson ..... 359/822 |
| 7,038,712 | B1 | 5/2006 | Livingston et al. |

(Continued)

FOREIGN PATENT DOCUMENTS

| | | | |
|---|---|---|---|
| AU | 2006252324 | B1 | 1/2007 |
| EP | 0655706 | A1 | 5/1995 |

(Continued)

OTHER PUBLICATIONS

U.S. Appl. No. 11/955,209, filed Dec. 12, 2007, Bledsoe, et al "Printing on Planar or Non-Planar Print Survace with Handhel Printing Device", 51 pages.

(Continued)

*Primary Examiner* — Cuong H Nguyen

(57) ABSTRACT

Systems, apparatuses, and methods for an image translation device are described herein. The image translation device may include a navigation sensor defining a sensor coordinate system askew to a body coordinate system defined by a body of the image translation device. Other embodiments may be described and claimed.

20 Claims, 8 Drawing Sheets

(56) References Cited

U.S. PATENT DOCUMENTS

| | | | | |
|---|---|---|---|---|
| 7,200,560 | B2 | 4/2007 | Philbert | |
| 7,297,912 | B1 * | 11/2007 | Todoroff et al. | 250/205 |
| 7,382,129 | B2 * | 6/2008 | Mills | 324/318 |
| 7,410,100 | B2 | 8/2008 | Muramatsu | |
| 7,607,749 | B2 | 10/2009 | Tabata et al. | |
| 7,845,748 | B2 | 12/2010 | Mealy et al. | |
| 7,876,472 | B2 | 1/2011 | Gudan et al. | |
| 7,929,019 | B2 | 4/2011 | Ohmura et al. | |
| 7,949,370 | B1 | 5/2011 | Bledsoe et al. | |
| 7,988,251 | B2 | 8/2011 | Dimitrijevic et al. | |
| 2002/0154186 | A1 | 10/2002 | Matsumoto | |
| 2002/0158955 | A1 | 10/2002 | Hess et al. | |
| 2003/0150917 | A1 | 8/2003 | Tsikos et al. | |
| 2003/0156300 | A1 | 8/2003 | Johnson | |
| 2004/0021912 | A1 | 2/2004 | Tecu et al. | |
| 2004/0027127 | A1 | 2/2004 | Mills | |
| 2004/0109034 | A1 | 6/2004 | Brouhon | |
| 2004/0208346 | A1 * | 10/2004 | Baharav et al. | 382/124 |
| 2005/0001867 | A1 | 1/2005 | Akase | |
| 2006/0012660 | A1 | 1/2006 | Dagborn | |
| 2006/0061647 | A1 | 3/2006 | Breton | |
| 2007/0150194 | A1 | 6/2007 | Chirikov | |
| 2008/0007762 | A1 | 1/2008 | Robertson et al. | |
| 2008/0144053 | A1 | 6/2008 | Gudan et al. | |
| 2008/0212120 | A1 | 9/2008 | Mealy et al. | |
| 2009/0034018 | A1 | 2/2009 | Lapstun et al. | |
| 2009/0279148 | A1 | 11/2009 | Lapstun et al. | |
| 2010/0039669 | A1 | 2/2010 | Chang et al. | |
| 2010/0231633 | A1 | 9/2010 | Lapstun et al. | |

FOREIGN PATENT DOCUMENTS

| | | | |
|---|---|---|---|
| EP | 1209574 | A2 | 5/2002 |
| JP | 2002307756 | A | 10/2002 |
| JP | 2006341604 | A | 12/2006 |
| WO | W003/076196 | A1 | 9/2003 |

OTHER PUBLICATIONS

U.S. Appl. No. 11/955,228, filed Dec. 12, 2007, Bledsoe et al., "Scanner for a Mobile Device", 34 pages.

U.S. Appl. No. 11/955,240, filed Dec. 12, 2007, Bledsoe et al., "Image Translation Device for a Mobile Device," 42 pages.

U.S. Appl. No. 11/955,258, filed Dec. 12,02007, Simmons, et al., "Printer for a Mobile Device," 37 pages.

U.S. Appl. No. 11/959,027, filed Dec. 18, 2007, Simmons et al., "Ergonomic Design for a Handheld Image Translation Device," 25 pages.

U.S. Appl. No. 11/968,528, filed Jan. 2, 2008, Simmons et al., "Determining End of Print Job in Handheld Image Translation Device," 45 pages.

U.S. Appl. No. 11/972,462, filed Jan. 10, 2008, Simmons et al., "Usage Maps in Image Deposition Devices," 39 pages.

U.S. Appl. No. 12/013,313, filed Jan. 11, 2008, Bledsoe et al., "Adaptive Filtering Scheme in Handheld Positioning Device," 38 pages.

U.S. Appl. No. 12/036,996, filed Feb. 25, 2008, Bledsoe et al., "Determining Positioning of a Handheld Image Translation Device," 41 pages.

U.S. Appl. No. 12/037,029, filed Feb. 25, 2008, Bledsoe et al., "Definition of Print Image for Image Translation Device," 36 pages.

U.S. Appl. No. 12/037,043, filed Feb. 25, 2008, Bledsoe et al., "Bit Selection from Print in Image Transalation Device," 43 pages.

U.S. Appl. No. 12/038,660, filed Feb. 27, 2008, McKinley et al., "Providing User Feedback in Handheld Device," 40 pages.

U.S. Appl. No. 12/041,496, filed Mar. 3, 208, Mealy, "Handheld Image Translation Device," 40 pages.

U.S. Appl. No. 12/041,515, filed Mar. 3, 2008, Mealy et al., "Position Correction in Handheld Translation Device," 42 pages.

U.S. Appl. No. 12/041,535, filed Mar. 3, 2008, Mealy et al., "Dynamic Image Dithering," 34 pages.

U.S. Appl. No. 12/062,472, filed Apr. 3, 2008, McKinley et al., "Image Translation Device Providing Navigational Data Feedback to communication Device," 39 pages.

U.S. Appl. No. 12/188,056, filed Aug. 7, 2008, Mealy et al., "Controlling a Plurality of Nozzles of a Handheld Printer," 47 pages.

Drzymala et al., "A Feasibilty Study Using a Stereo-optical Camera System to Verify Gamma Knife Treatment Specifications", Proceedings of the 22nd annual EMBS International Conference, Jul. 23-28, 2000, Chicago, IL, 4 pages.

Fairchild, "IEEE 1284 Interface Design Solutions", Jul. 1999, Fairchild Semiconductor, AN-5010, 10 pages.

Liu, "Determiantion of the Point of Fixation in a Head-Fixed Coordinate System", 1998 Proceedings. Fourteenth International Conference on Pattern Recognition; vol. 1; Digital Object Identifier, Published 1998, 4 pages.

Texas Instruments, "Program and Data Memory Controller", Sep. 2004, SPRU577A, 115 pages.

* cited by examiner

METHOD AND APPARATUS FOR DETERMINING A POSITION OF A HANDHELD IMAGE TRANSLATION DEVICE OVER A MEDIUM WHILE USING THE HANDHELD IMAGE TRANSLATION DEVICE TO TRANSLATE AN IMAGE ONTO THE MEDIUM

CROSS-REFERENCES TO RELATED APPLICATIONS

This present disclosure is a continuation of and claims priority to U.S. patent application Ser. No. 12/016,833, filed Jan. 18, 2008, now U.S. Pat. No. 8,396,654, issued Mar. 12, 2013, which claims priority to U.S. Patent Application No. 60/885,481, filed on Jan. 18, 2007, which are incorporated herein by reference.

TECHNICAL FIELD

Embodiments of the present invention relate to the field of image translation and, in particular, to sensor positioning in a handheld image translation device.

BACKGROUND

Traditional printing devices rely on a mechanically operated carriage to transport a print head in a linear direction as other mechanics advance a print medium in an orthogonal direction. As the print head moves over the print medium an image may be laid down. Portable printers have been developed through technologies that reduce the size of the operating mechanics. However, the principles of providing relative movement between the print head and print medium remain the same as traditional printing devices. Accordingly, these mechanics limit the reduction of size of the printer as well as the material that may be used as the print medium.

Handheld printing devices have been developed that ostensibly allow an operator to manipulate a handheld device over a print medium in order to print an image onto the medium. However, these devices are challenged by the unpredictable and nonlinear movement of the device by the operator. The variations of operator movement, including rotation of the device itself, make it difficult to determine the precise location of the print head. This type of positioning error may have deleterious effects of the quality of the printed image.

SUMMARY

At least some embodiments include a handheld image translation device that may accurately determine a position, including translation and rotation, of the device during an image translation operation. More specifically, there is provided, in accordance with various embodiments of the present invention, a device that includes a body defining a coordinate system; a navigation sensor defining a sensor coordinate system askew to the body coordinate system; and a position module configured to control the navigation sensor to capture a plurality of navigational images and to determine a position of the apparatus based at least in part on the plurality of navigational images.

In some embodiments, the device may be an image translation device and include one or more input/output components; and an input/output module configured to control the one or more input/output components to translate image information between the apparatus and an adjacent medium.

The one or more input/output components may include a print head and/or an optical imaging sensor.

In some embodiments, the device may include a second navigation sensor defining a second sensor coordinate system askew to the body coordinate system. The second sensor coordinate system may also be askew to the first sensor coordinate system.

In some embodiments, the first and second navigation sensors may include respective image apertures, wherein a line between the image apertures is not parallel with a longitudinal axis of the coordinate system of the body.

In some embodiments an angle between a transverse axis of the sensor coordinate system and a transverse axis of the body coordinate system may be between thirty to sixty degrees. In some embodiments this angle may be forty-five degrees.

In some embodiments, the position module is configured to determine the position of the apparatus relative to a reference location.

A method of positioning a device such as an image translation device may also be disclosed in accordance with various embodiments. The method may include controlling a navigation sensor that defines a sensor coordinate system askew to a body coordinate system defined by a body of the device, to capture a plurality of navigational images; and determining position information of the image translation device based at least in part on the plurality of navigational images.

In some embodiments, the method may further include translating image information between the image translation device and an adjacent medium based at least in part on the position information.

In some embodiments, the method may further include controlling a second navigation sensor, having a second sensor coordinate system askew to the body coordinate system, to capture another plurality of navigational images; and determining the position information based at least further in part on the another plurality of navigational images.

In some embodiments, determining the position information may include determining a translation of the navigation sensor within the sensor coordinate system; and transforming the translation into a translation within a world-space coordinate system.

In some embodiments, determining the position information may include determining a rotation of the navigation sensor within the world-space coordinate system; and transforming the translation into the translation within the world-space coordinate system based at least in part on the rotation.

In some embodiments, determining the rotation of the navigation sensor comprises determining a difference between the translation of a first navigation sensor within its coordinate system and a translation of a second navigation sensor within its coordinate system.

A positioning device may also be disclosed having a means for controlling a navigation sensor that defines a sensor coordinate system askew to a body coordinate system defined by a body of the apparatus, to capture a plurality of navigational images; and means for determining position information of the apparatus based at least in part on the plurality of navigational images.

In some embodiments, the device may further include means for translating image information between the image translation device and an adjacent medium based at least in part on the position information.

In some embodiments, the device may further include means for controlling a second navigation sensor, having a second sensor coordinate system askew to the body coordinate system, to capture another plurality of navigational images; and means for determining the position information based at least further in part on the another plurality of navigational images.

In some embodiments, the means for determining may include means for determining a translation of the navigation sensor within the sensor coordinate system; and means for transforming the translation into a translation within a world-space coordinate system.

In some embodiments, the means for determining the position information may include means for determining a rotation of the navigation sensor within the world-space coordinate system; and means for transforming the translation into the translation within the world-space coordinate system based at least in part on the rotation.

In some embodiments, the means for determining the rotation of the navigation sensor may include means for determining a difference between the translation of the navigation sensor within the sensor coordinate system and a translation of a second navigation sensor within a second sensor coordinate system.

Other features that are considered as characteristic for embodiments of the present invention are set forth in the appended claims.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

In the following detailed description, reference is made to the accompanying drawings which form a part hereof wherein like numerals designate like parts throughout, and in which are shown, by way of illustration, specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

The description may use perspective-based descriptions such as up/down, back/front, and top/bottom. Such descriptions are merely used to facilitate the discussion and are not intended to restrict the application of embodiments of the present invention.

Reference in the specification to "one embodiment" or "an embodiment" means that a particular feature, structure, or characteristic described in connection with the embodiment is included in at least one embodiment. The appearances of the phrase "in one embodiment" in various places in the specification do not necessarily all refer to the same embodiment, but they may.

The phrase "A and/or B" means (A), (B), or (A and B). The phrase "A, B, and/or C" means (A), (B), (C), (A and B), (A and C), (B and C) or (A, B and C). The phrase "(A) B" means (A B) or (B), that is, A is optional.

Figure 1:
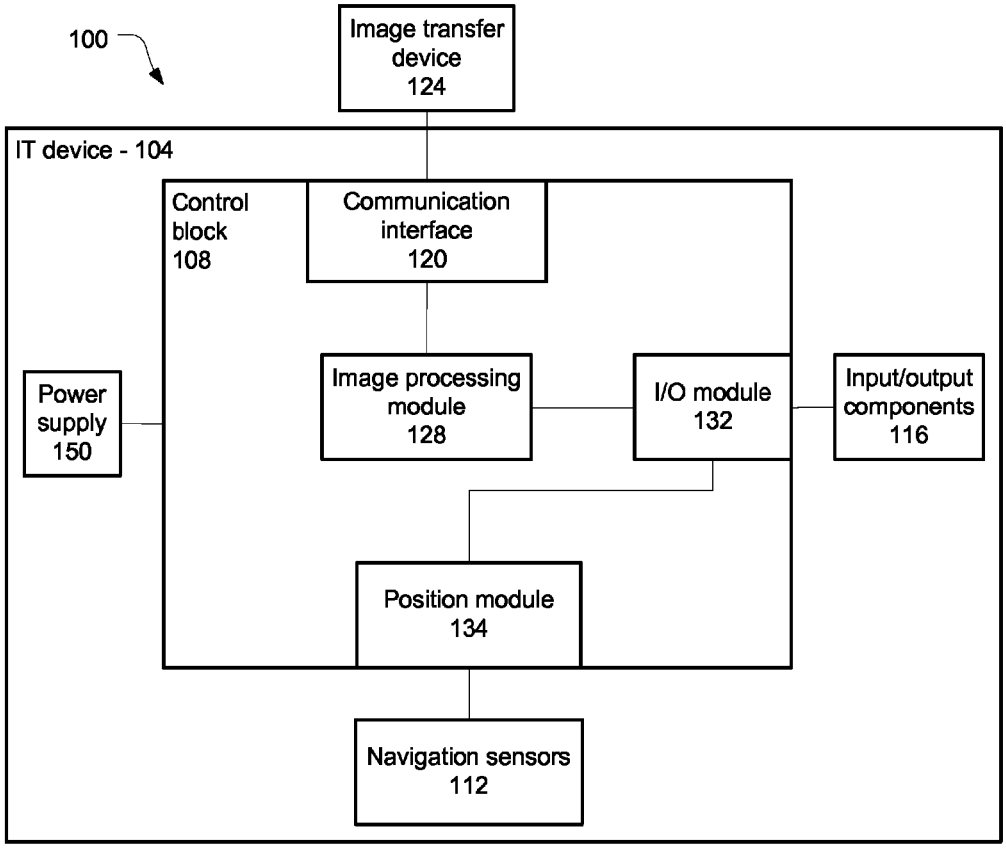
FIG. 1 is a schematic of a system including a handheld image translation device in accordance with various embodiments of the present invention.

FIG. 1 is a schematic of a system 100 including a handheld image translation (IT) device 104 in accordance with various embodiments of the present invention. The IT device 104 may include a control block 108 with components designed to control one or more navigation sensors 112 in a manner to facilitate precise and accurate positioning of one or more input/output components 116 throughout an entire IT operation. This positioning, which may be facilitated through the arrangement of the navigation sensors 112 as will be described in further detail herein, may allow the IT device 104 to reliably translate an image in a truly mobile and versatile platform.

Image translation, as used herein, may refer to a translation of an image that exists in a particular context (e.g., medium) into an image in another context. For example, an IT operation may be a scan operation. In this situation, a target image, e.g., an image that exists on a tangible medium, is scanned by the IT device 104 and an acquired image that corresponds to the target image is created and stored in memory of the IT device 104. For another example, an IT operation may be a print operation. In this situation, an acquired image, e.g., an image as it exists in memory of the IT device 104, may be printed onto a print medium.

The control block 108 may include a communication interface 120 configured to communicatively couple the control block 108 to an image transfer device 124. The image transfer device 124 may include any type of device capable of transmitting/receiving data related to an image involved in an IT operation. The image transfer device 124 may include a general purpose computing device, e.g., a desktop computing device, a laptop computing device, a mobile computing device, a personal digital assistant, a cellular phone, etc. or it may be a removable storage device, e.g., a flash memory data storage device, designed to store data such as image data. If the image transfer device 124 is a removable storage device, e.g., a universal serial bus (USB) storage device, the communication interface 120 may be coupled to a port, e.g., USB port, of the IT device 104 designed to receive the storage device.

The communication interface 120 may include a wireless transceiver to allow the communicative coupling with the image transfer device 124 to take place over a wireless link. The image data may be wirelessly transmitted over the link through the modulation of electromagnetic waves with frequencies in the radio, infrared, or microwave spectrums.

A wireless link may contribute to the mobility and versatility of the IT device 104. However, some embodiments may additionally/alternatively include a wired link communicatively coupling the image transfer device 124 to the communication interface 120.

In some embodiments, the communication interface 120 may communicate with the image transfer device 124 through one or more wired and/or wireless networks including, but not limited to, personal area networks, local area networks, wide area networks, metropolitan area networks, etc. The data transmission may be done in a manner compatible with any of a number of standards and/or specifications including, but not limited to, 802.11, 802.16, Bluetooth, Global System for Mobile Communications (GSM), code-division multiple access (CDMA), Ethernet, and the like.

In an embodiment where an IT operation includes a print operation, the image transfer device 124 may transfer image data related to an image to be printed to the IT device 104 through the communication interface 120. The communication interface 120 may then transmit the received image data to an on-board image processing module 128. The image processing module 128 may process the received image data in a manner to facilitate an upcoming printing process. Image processing techniques may include dithering, decompression, half-toning, color plane separation, and/or image storage. In various embodiments some or all of these image processing operations may be performed by the image transfer device 124 or another device. The processed image may then be transmitted to an input/output (I/O) module 132, which may function as a print module in this embodiment, where it is cached in anticipation of the printing of the image.

The I/O module 132 may also receive positioning information, indicative of a position of a print head of the I/O components 116 relative to a reference location, from a position module 134. The position module 134 may control the navigation sensors 112 to track incremental movement of the IT device 104 relative to a reference location.

Once the I/O module 132 receives the positioning information it may coordinate the location of the print head to a portion of the processed image with a corresponding location. The I/O module 132 may then control the print head in a manner to deposit a printing substance on a print medium adjacent to the IT device 104 to represent the corresponding portion of the processed image.

A print medium, as used herein, may be any type of medium on which a printing substance, e.g., ink, powder, etc., may be deposited. It is not limited to print paper or other thin, flexible print media commonly associated with traditional printing devices.

The print head may be an inkjet print head having a plurality of nozzles designed to emit liquid ink droplets. The ink, which may be contained in reservoirs or cartridges, may be black and/or any of a number of various colors. A common, full-color inkjet print head may have nozzles for cyan, magenta, yellow, and black ink. Other embodiments may utilize other printing techniques, e.g., toner-based printers such as laser or LED printers, solid ink printers, dye-sublimation printers, inkless printers, etc.

In an embodiment in which an IT operation includes a scanning operation, the I/O module 132 may function as an image capture module and may be communicatively coupled to one or more optical imaging sensors of the I/O components 116. Optical imaging sensors, which may include a number of individual sensor elements, may be designed to capture a plurality of surface images of a medium adjacent to the IT device 104. The surface images may be individually referred to as component surface images. The I/O module 132 may generate a composite image by stitching together the component surface images. The I/O module 132 may receive positioning information from the position module 134 to facilitate the arrangement of the component surface images into the composite image.

Relative to the navigation sensors, the optical imaging sensors may have a higher resolution, smaller pixel size, and/or higher light requirements. While the navigation sensors are configured to capture details about the structure of the underlying medium, the optical imaging sensors may be configured to capture an image of the surface of the medium itself.

In an embodiment in which the IT device 104 is capable of scanning full color images, the optical imaging sensors may have sensor elements designed to scan different colors.

A composite image acquired by the IT device 104 may be subsequently transmitted to the image transfer device 124 by, e.g., e-mail, fax, file transfer protocols, etc. The composite image may be additionally/alternatively stored locally by the IT device 104 for subsequent review, transmittal, printing, etc.

In addition (or as an alternative) to composite image acquisition, an image capture module may be utilized for calibrating the position module 134. In various embodiments, the component surface images (whether individually, some group, or collectively as the composite image) may be compared to the processed print image rendered by the image processing module 128 to correct for accumulated positioning errors and/or to reorient the position module 134 in the event the position module 134 loses track of its reference point. This may occur, for example, if the IT device 104 is removed from the print medium during an IT operation.

The IT device 104 may include a power supply 150 coupled to the control block 108. The power supply 150 may be a mobile power supply, e.g., a battery, a rechargeable battery, a solar power source, etc. In other embodiments the power supply 150 may additionally/alternatively regulate power provided by another component (e.g., the image transfer device 124, a power cord coupled to an alternating current (AC) outlet, etc.).

Figure 2:
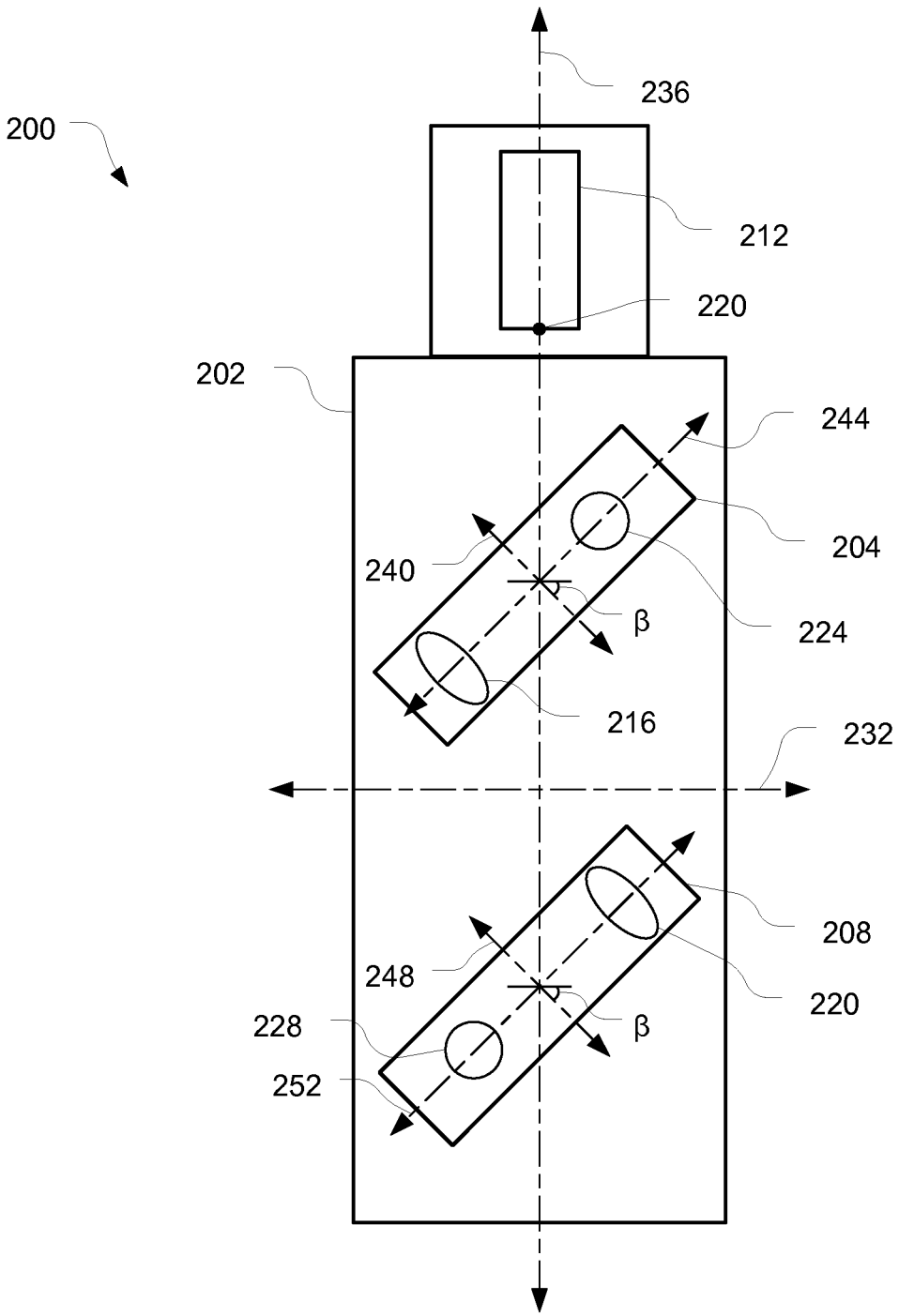
FIG. 2 is a bottom plan view of a handheld image translation device in accordance with various embodiments of the present invention.

FIG. 2 is a bottom plan view of an IT device 200 in accordance with various embodiments of the present invention. The IT device 200 may have a body 202 housing navigation sensors 204 and 208 and an I/O component 212. The IT device 200 may be substantially interchangeable with IT device 104 and like-named elements may be similar among the various embodiments.

As briefly discussed above, the navigation sensors 204 and 208 may be used by a position module, e.g., position module 134, to determine positioning information related to the I/O component 212. The navigation sensors 204 and 208 may each have a respective light source 216 and 220 and an optoelectronic sensor exposed through image apertures 224 and 228. The light sources 216 and 220, which may include a light emitting device (LED), a laser, etc., may illuminate a medium adjacent to the IT device 200 and the respective optoelectronic sensor may record the reflected light as a series of navigation images as the IT device 104 is moved over the medium.

The navigation sensors 204 and 208 may have operating characteristics sufficient to track movement of the IT device 200 with the desired degree of precision. In one example, the navigation sensors 204 and 208 may process approximately 2000 frames per second, with each frame including a rectangular array of 30×30 pixels. Each pixel may detect a six-bit interference pattern value, e.g., capable of sensing 64 different levels of patterning.

The position module may process the navigation images to detect structural variations of the medium. The movement of the structural variations in successive images may indicate motion of the IT device 200 relative to the medium. Tracking this relative movement may facilitate determination of the precise positioning of the navigation sensors 204 and 208.

Incremental delta values between successive images may be recorded and accumulated to determine a position of the IT device 200 in general, and the I/O components 212 in particular, relative to a reference location as will be described herein.

The body 202 may define a body coordinate system with a transverse axis 232 and a longitudinal axis 236. The navigation sensor 204 may define a sensor coordinate system with a transverse axis 240 and a longitudinal axis 244, which runs through both the image aperture 224 and the light source 216. Similarly, the navigation sensor 208 may define a sensor coordinate system with a transverse axis 248 and a longitudinal axis 252, which runs through both the image aperture 228 and the light source 220.

In a typical IT operation, the predominant movement of the IT device 200 may be along its transverse axis 232. This motion may be encouraged by the dimensioning and arrangement of the I/O components 212. For example, if the I/O components 212 include a print head, the print head may have rows of colored nozzles arranged in parallel with the longitudinal axis 236. Therefore, the most efficient way to completely cover a print medium is to move the IT device 200 to produce lateral print swaths with each subsequent print swath at least partially overlapping the previous swath.

It may be that a navigation sensor (and accompanying position module) may have difficulty accurately correlating successive navigational images when movement is primarily along one of its native axes. Accordingly, in embodiments of the present invention the navigation sensors 204 and 208 may be arranged in the IT device 200 such that their respective coordinate systems are askew to the body coordinate system. This may be accomplished by ensuring, e.g., that the transverse axes 240 and 248 are not parallel with the transverse axis 232. Thus, when the IT device 200 is moved along its transverse axis 232, the navigation sensors 204 and 208 will experience both transverse motion (e.g., to accumulate $\Delta x$ values) and longitudinal motion (e.g., to accumulate $\Delta y$ values). The accuracy of the derived position information may then be increased by the full utilization of all four x and y values from the two sensors 204 and 208.

As shown, the skewed arrangement of the sensors may result in each of the transverse axes 240 and 248 forming an angle $\beta$ with the transverse axis 232. The value of the angle $\beta$ may be anywhere between zero and ninety degrees. In some embodiments the value of the angle $\beta$ may be between thirty to sixty degrees. Providing an angle $\beta$ of forty-five degrees may be particularly useful in obtaining accurate positioning information as motion along the transverse axis 232 may be equally split between the sensors' transverse and longitudinal axes.

While this embodiment shows both the transverse axes 240 and 248 having the same angular offset from the transverse axis 232 other embodiments may have different angular offsets. This may ensure that even if the IT device 200 was moved in a direction parallel with one of the sensor's axis, the other sensor's axis would record both transverse and longitudinal motion.

As discussed above, the proximal relationship of the I/O components 212 and the sensors 204 and 208 may be fixed to facilitate the positioning of the I/O components 212 through information obtained by the navigation sensors 204 and 208. Accordingly, there may be four main geometrical elements to consider when computing the parameters for accurate image translation: location of an I/O component datum 220, location of the image apertures 224 and 228, and the rotation angle $\beta$ of the sensors 204 and 208 with respect to the body 202.

Figure 3:
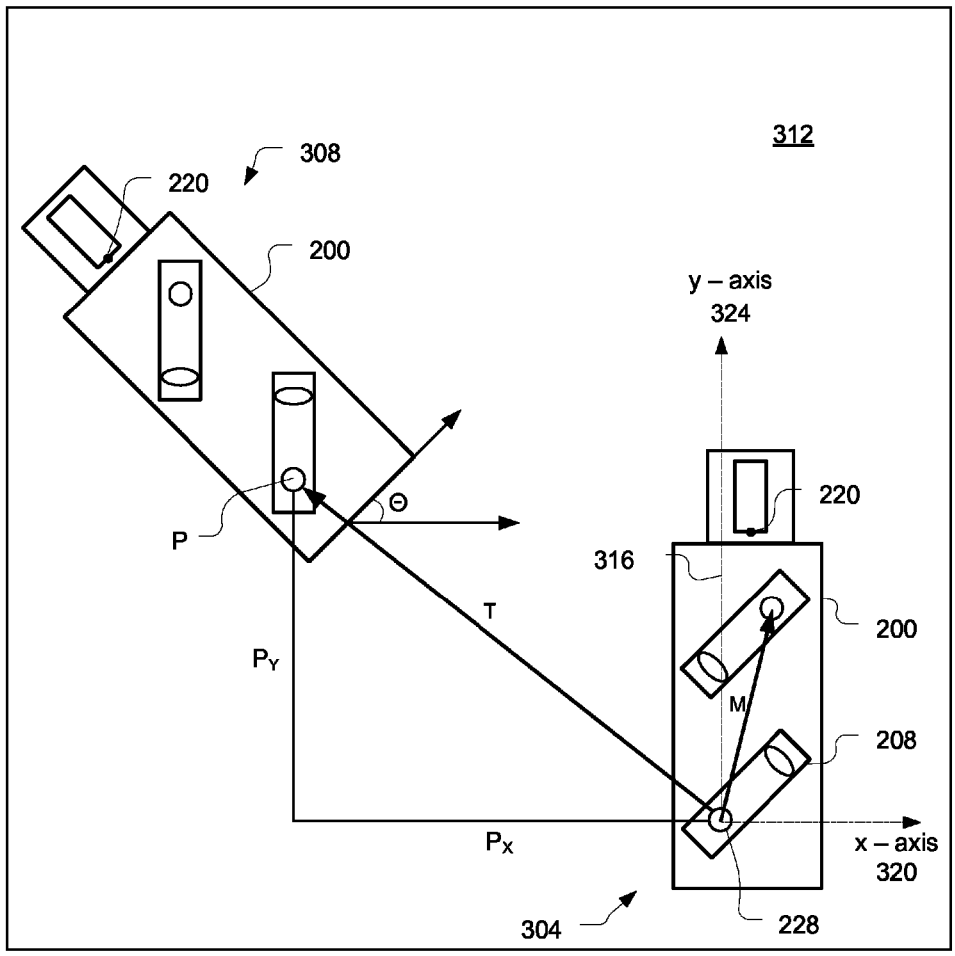
FIG. 3 is a bottom plan view of the handheld image translation device in a reference and a subsequent location in accordance with various embodiments of the present invention.

FIG. 3 illustrates a positioning of an image aperture in accordance with an embodiment of the present invention. In this embodiment, the IT device 200 may begin at a reference location 304 and move to a subsequent location 308. To obtain position information related to the datum 220 in the subsequent location 308, the incremental motion of a sensor, e.g., sensor 208, may be broken down into world space (w-s) rotation angles and translation vector as will be described herein.

The reference location 304 may be established by the IT device 200 being set on a print medium 312 and zeroed out. In establishing the reference location, the user may be instructed to align the datum 220 or another reference of the IT device 200 at a certain location of the print medium 312 (e.g., bottom left corner of the print medium 312) and/or a certain location of the image to be printed (e.g., the bottom left corner of the image to be printed).

When the reference location 304 is established, a w-s coordinate system 316 may be provided in alignment with the coordinate system of the body 202. The w-s coordinate system 316 may include an origin set at the location of the image aperture 228 (or some other point), an x-axis 320 that is parallel to the transverse axis 232 of the body 202, and a y-axis 324 that is parallel to the longitudinal axis 236 of the body 202. Accordingly, at the reference location, the transverse axis 248 of the sensor 208 may be rotated an angle $-\beta$ relative to the x-axis 320.

The w-s coordinate system 316 may remain fixed throughout the IT operation. When the IT device 200 is moved, its coordinate system may also move and therefore may no longer be aligned with the w-s coordinate system 316.

As the IT device 200 is moved from the reference location 304 to the subsequent location 308, the sensor 208 may report incremental delta values in its own coordinate system, which may be transformed into the w-s coordinate system 316 to determine a w-s rotation angle $\Theta$ and a w-s translation vector T.

Figure 4:
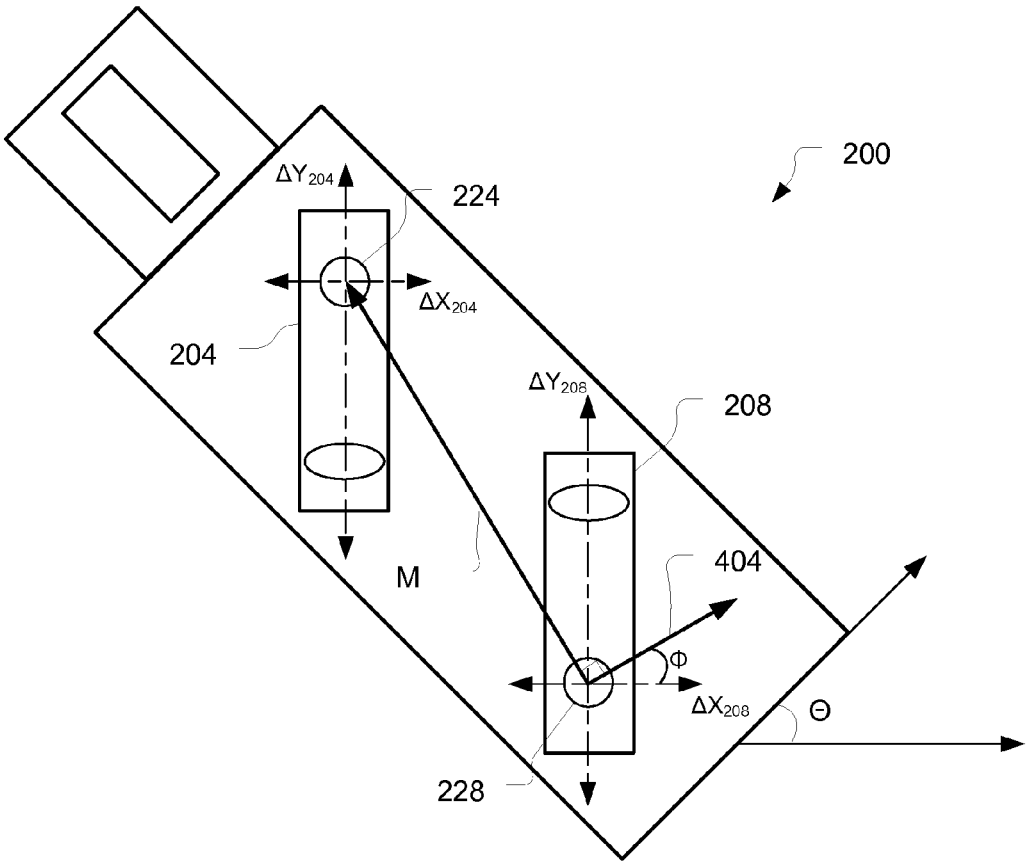
FIG. 4 is a bottom plan view of the handheld image translation device rotated a world-space rotation angle in accordance with various embodiments of the present invention.

A determination of the w-s rotation angle $\Theta$ may be described with additional reference to FIG. 4. Rotation of the IT device 200 about the image aperture 228 may be determined from the difference between the two sensors' accumulated motion along a rotation unit vector 404. The rotation unit vector 404 may be a vector in sensor coordinate space that is perpendicular to a line M connecting the centers of the image apertures 224 and 228. The rotation unit vector 404 may be given by the following equations.

$$U_X = X_{404}/L, \text{ and} \quad \text{EQ. 1}$$

$$U_Y = Y_{404}/L, \quad \text{EQ. 2}$$

wherein L is the length of line M. It may be noted that in some embodiments the rotation unit vectors may be different for each of the sensors 204 and 208, e.g., if the sensors have different orientations.

Rotation components of the sensors 204 and 208 ($R_{204}$ and $R_{208}$, respectively) may be computed by dotting accumulated motion into the rotation unit vector 404. The rotation components may be computed by the following equations.

$$R_{x\text{-}204} = \Sigma(\Delta X_{204} * U_{x\text{-}204}); \quad \text{EQ. 3}$$

$$R_{y\text{-}204} = \Sigma(\Delta Y_{204} * U_{y\text{-}204}) \quad \text{EQ. 4}$$

$$R_{x\text{-}208}=\Sigma(\Delta X_{208}*U_{x\text{-}208});\quad \text{EQ. 5}$$

$$R_{y\text{-}208}=\Sigma(\Delta Y_{208}*U_{y\text{-}208})\quad \text{EQ. 6}$$

The $R_{x\text{-}204}$ rotation component is the x component of the accumulated unit dot of the sensor 204; the $R_{y\text{-}204}$ rotation component is the y component of the accumulated unit dot of the sensor 204; and so on. $R_{204}$ and $R_{208}$, which may be scalar values, may represent the final sum of the x and y accumulations for the sensors 204 and 208, respectively.

$R_{204}$ and $R_{208}$ may be utilized in the calculation of the w-s rotation angle Θ by the following equation.

$$\Theta=(R_{204}-R_{208})/2\pi L,\quad \text{EQ. 7}$$

where the denominator is the arc length of the rotation angle Θ.

Referring again to FIG. 3, the w-s translation vector T may be computed by transforming the incremental position value changes of the sensor 208 (e.g., $\Delta X_{208}$ and $\Delta Y_{208}$) by the total rotation angle Θ. The w-s incremental position value changes (e.g., $\Delta T_X$ and $\Delta T_Y$) may be computed as follows.

$$\Delta T_X=\Delta X_{208}\cos\Theta-\Delta Y_{208}\sin\Theta,\quad \text{EQ. 8}$$

$$\Delta T_Y=\Delta X_{208}\sin\Theta+\Delta Y_{208}\cos\Theta.\quad \text{EQ. 9}$$

The w-s position P of image aperture 228 may then be computed by summing the w-incremental position value changes, $$P_X=\Sigma\Delta T_X,\quad \text{EQ. 10}$$

$$P_Y=\Sigma\Delta T_Y.\quad \text{EQ. 11}$$

Figure 5:
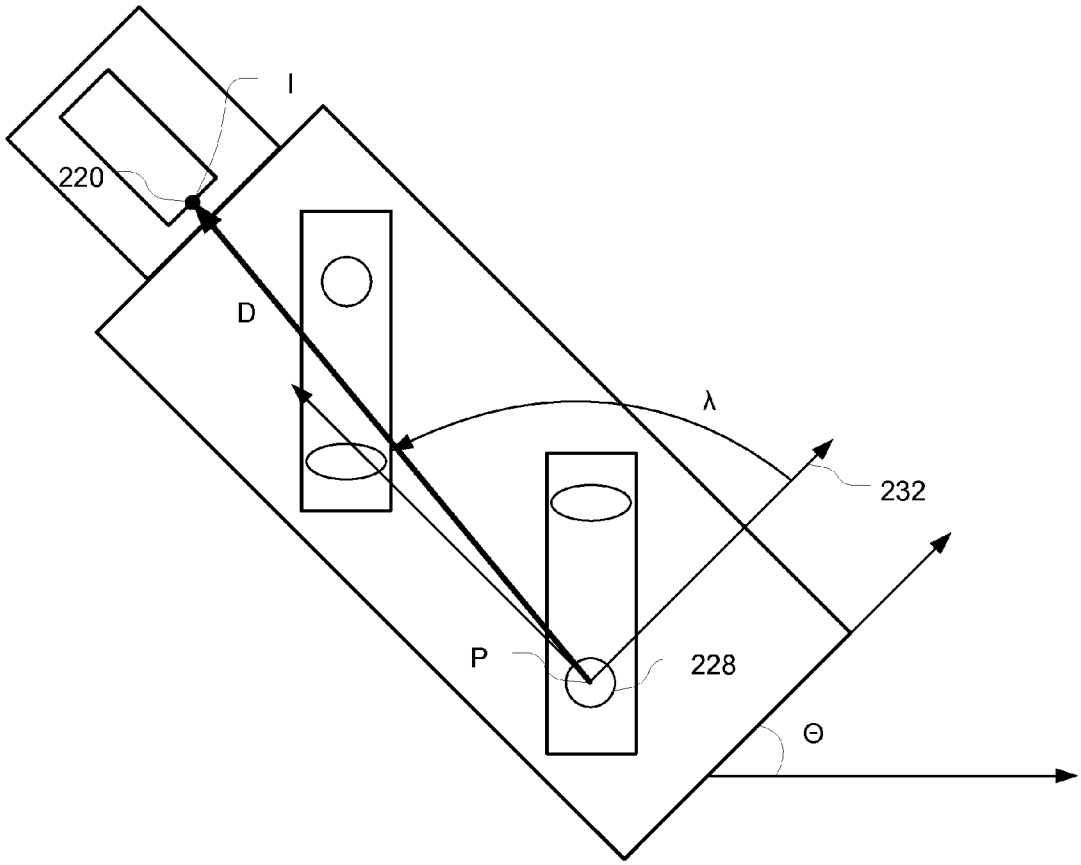
FIG. 5 is a bottom plan view of the handheld image translation device illustrating a determination of a location of a component datum in accordance with various embodiments of the present invention.

Once the w-s position P is determined, the coordinates of the datum 220 may be obtained as explained with reference to FIG. 5. The w-s coordinates of the datum 220 may be determined by translating P by an angle λ between a line connecting the image aperture 228 to the datum 220 and the transverse axis 232 of the body 202. The w-s position I of the datum 220, given by w-s coordinates $I_X$ and $I_Y$ may then be determined as follows.

$$I_X=Dx\cos\lambda-Dy\sin\lambda,\quad \text{EQ. 12}$$

$$I_Y=Dx\sin\lambda+Dy\cos\lambda,\quad \text{EQ. 13}$$

where D is the distance between the image aperture 228 and the datum 220.

In this manner, the arrangement of the navigation sensors 204 and 208 may facilitate the provisioning of accurate positioning information that may be used to determine the w-s positioning of the datum 220 throughout an IT operation of a particular embodiment.

Figure 6:
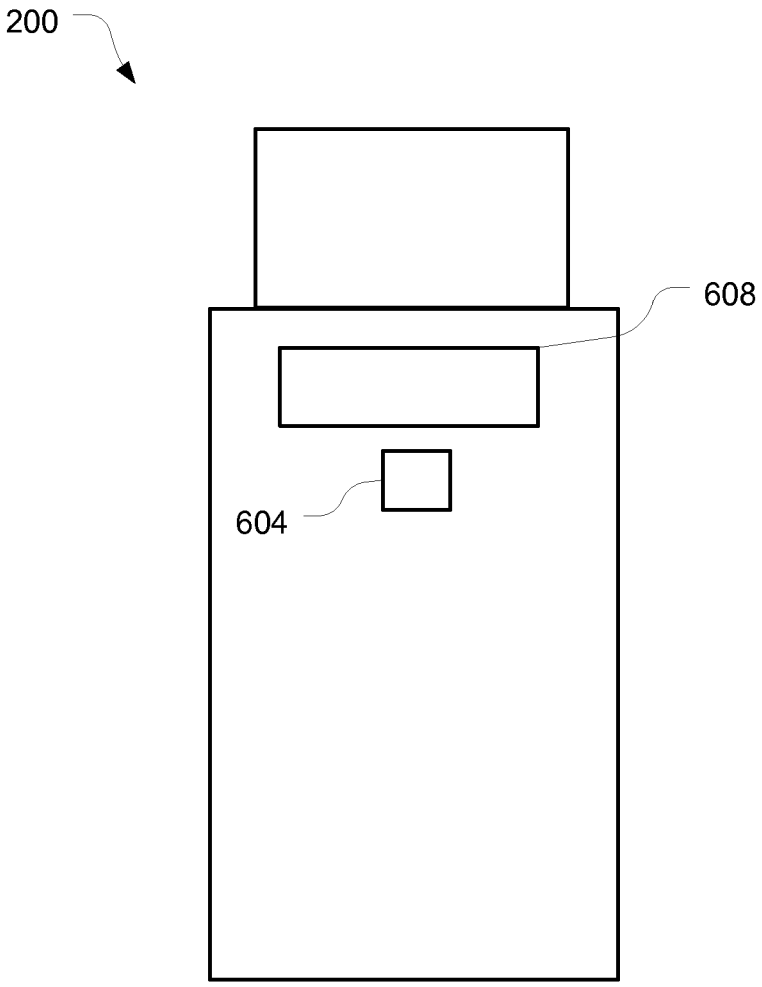
FIG. 6 is a top plan view of the handheld image translation device in accordance with various embodiments of the present invention.

FIG. 6 is a top plan view of the IT device 200 in accordance with various embodiments of the present invention. The IT device 200 may have a variety of user input/outputs to provide the functionality enabled through use of the IT device 200. Some examples of input/outputs that may be used to provide some of the basic functions of the IT device 200 include, but are not limited to, an IT control input 604 to initiate/resume an IT operation and a display 608.

The display 608, which may be a passive display, an interactive display, etc., may provide the user with a variety of information. The information may relate to the current operating status of the IT device 200 (e.g., printing, ready to print, receiving print image, transmitting print image, etc.), power of the battery, errors (e.g., positioning/printing error, etc.), instructions (e.g., "place IT device on print medium prior to initiating printing operation," etc.). If the display 608 is an interactive display it may provide a control interface in addition to, or as an alternative from, the IT control input 604.

Figure 7:
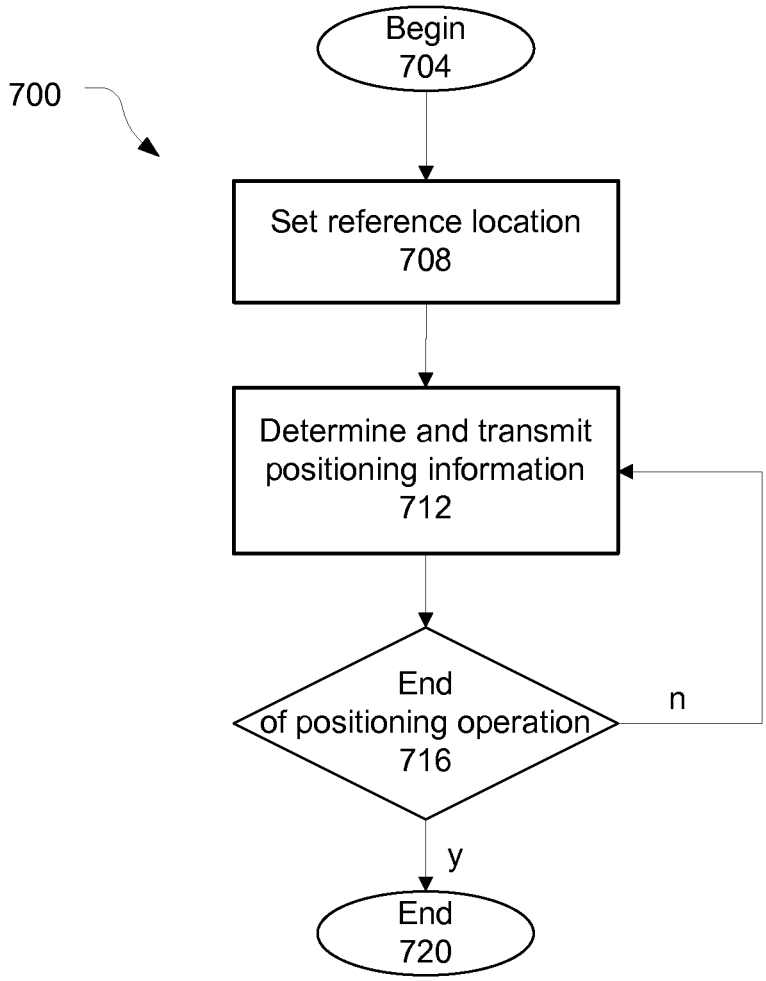
FIG. 7 is a flow diagram depicting a positioning operation of a handheld image translation device in accordance with various embodiments of the present invention.

FIG. 7 is a flow diagram 700 depicting a positioning operation of the IT device 200 in accordance with various embodiments of the present invention. A positioning operation may begin at block 704 with an initiation of an IT operation, e.g., by activation of the IT control input 604. A position module within the IT device 200 may set a reference location at block 708. The reference location may be set when the IT device 200 is placed onto a medium at the beginning of an IT job. This may be ensured by the user being instructed to activate the IT control input 604 once the IT device 200 is in place and/or by the proper placement of the IT device 200 being treated as a condition precedent to instituting the positioning operation. In some embodiments the proper placement of the IT device 200 may be automatically determined through the navigation sensors 204 and/or 208 and/or some other sensors (e.g., a proximity sensor).

Once the reference location is set at block 708, the position module may determine positioning information, e.g., translational and rotational changes from the reference location, using the navigation sensors 204 and 208 and transmit this positioning information to an input/output module at block 712. These transitional and/or rotational changes may be determined by the position module in manners similar to those previously discussed.

Following the position determination at block 712, the position module may determine whether the positioning operation is complete at block 716. If it is determined that the positioning operation is not yet complete, the operation may loop back to block 712. If it is determined that the positioning operation is complete, the operation may end in block 720. The end of the positioning operation may be tied to the end of the IT operation.

If an IT operation includes a print job, the determination of whether the end of the print job has been reached may be a function of the total printed volume versus the total anticipated print volume. In some embodiments the end of the print job may be reached even if the total printed volume is less than the total anticipated print volume. For example, an embodiment may consider the end of the print job to occur when the total printed volume is ninety-five percent of the total anticipated print volume. However, it may be that the distribution of the remaining volume is also considered in the end of print analysis. For example, if the five percent remaining volume is distributed over a relatively small area, the print job may not be considered to be completed.

In some embodiments, an end of print job may be established by a user manually cancelling the operation.

If the IT operation includes a scan job, the end of the scan job may be determined through a user manually cancelling the operation and/or through an automatic determination. In some embodiments, an automatic determination of the end of scan job may occur when all interior locations of a predefined image border have been scanned. The predefined image border may be determined by a user providing the dimensions of the image to be scanned or by tracing the border with the IT device 200 early in the scanning sequence.

Figure 8:
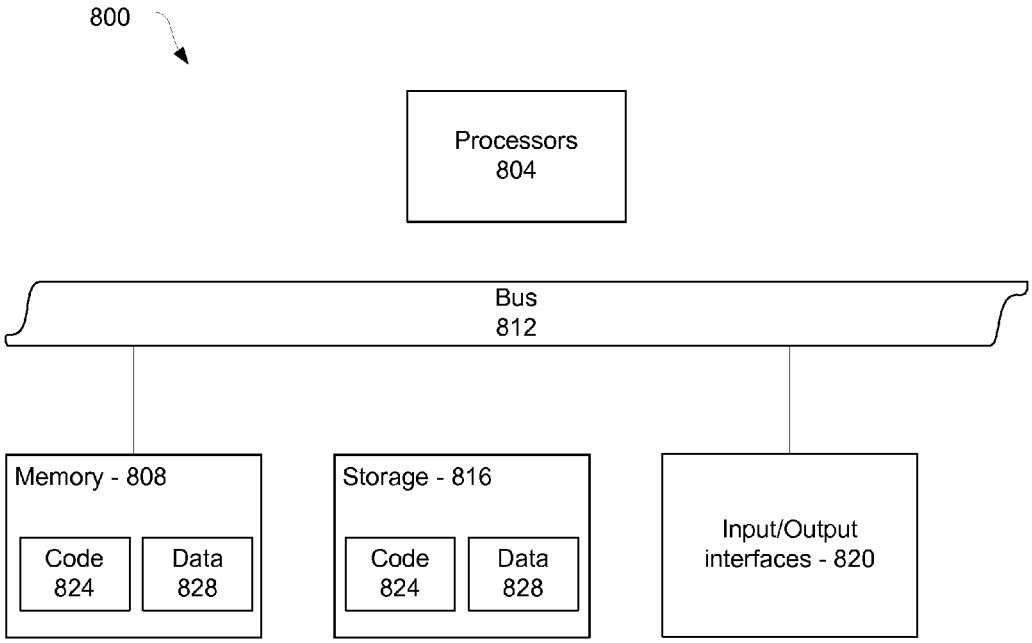
FIG. 8 illustrates a computing device capable of implementing a control block of a handheld image translation device in accordance with various embodiments of the present invention.

FIG. 8 illustrates a computing device 800 capable of implementing a control block, e.g., control block 108, in accordance with various embodiments. As illustrated, for the embodiments, computing device 800 includes one or more processors 804, memory 808, and bus 812, coupled to each other as shown. Additionally, computing device 800 includes storage 816, and one or more input/output interfaces 820 coupled to each other, and the earlier described elements as shown. The components of the computing device 800 may be designed to provide the positioning functions of a control block of an IT device as described herein.

Memory 808 and storage 816 may include, in particular, temporal and persistent copies of code 824 and data 828, respectively. The code 824 may include instructions that when accessed by the processors 804 result in the computing device 800 performing operations as described in conjunction with various modules of the control block in accordance with embodiments of this invention. The processing data 828 may include data to be acted upon by the instructions of the code 824. In particular, the accessing of the code 824 and data 828 by the processors 804 may facilitate image translation and/or positioning operations as described herein.

The processors 804 may include one or more single-core processors, multiple-core processors, controllers, application-specific integrated circuits (ASICs), etc.

The memory 808 may include random access memory (RAM), dynamic RAM (DRAM), static RAM (SRAM), synchronous DRAM (SDRAM), dual-data rate RAM (DDRRAM), etc.

The storage 816 may include integrated and/or peripheral storage devices, such as, but not limited to, disks and associated drives (e.g., magnetic, optical), USB storage devices and associated ports, flash memory, read-only memory (ROM), non-volatile semiconductor devices, etc. Storage 816 may be a storage resource physically part of the computing device 800 or it may be accessible by, but not necessarily a part of, the computing device 800. For example, the storage 816 may be accessed by the computing device 800 over a network.

The I/O interfaces 820 may include interfaces designed to communicate with peripheral hardware, e.g., I/O components 116, navigation sensors 112, etc., and/or remote devices, e.g., image transfer device 124.

In various embodiments, computing device 800 may have more or less elements and/or different architectures.

Although specific embodiments have been illustrated and described herein, it will be appreciated by those of ordinary skill in the art and others, that a wide variety of alternate and/or equivalent implementations may be substituted for the specific embodiment shown and described without departing from the scope of the present invention. This application is intended to cover any adaptations or variations of the embodiment discussed herein. Therefore, it is manifested and intended that the invention be limited only by the claims and the equivalents thereof.

What is claimed is:

1. A method for translating, via a image translation device, an image onto a medium, wherein the image translation device comprises a communication interface, an input/output module, a position module, a navigation sensor, and a print head, and wherein the method comprises:

receiving, at the communication interface of the image translation device, an image to be translated onto the medium; and as the image translation device is being moved over the medium to translate the image onto the medium, (i) tracking, via the navigation sensor of the image translation device, a non-linear movement of the image translation device relative to a fixed location on the medium, (ii) based on the tracked non-linear movement of the image translation device relative to the fixed location on the medium, determining, via the position module of the image translation device, a position of the print head relative to the fixed location on the medium, (iii) determining, via the input/output module of the image translation device, a portion of the image corresponding to the position of the print head relative to the fixed location on the medium, and (iv) depositing, via the print head of the image translation device, a printing substance onto the medium, wherein the printing substance deposited onto the medium represents the portion of the image corresponding to the position of the print head relative to the fixed location on the medium.

2. The method of claim 1, wherein the image translation device further comprises an image processor, and wherein the method further comprises:

processing the image, via the image processor of the image translation device, prior to translating the image onto the medium.

3. The method of claim 2, wherein processing the image comprises performing one or more of dithering, decompression, half-toning, color plane separation, or image storage.

4. The method of claim 1, wherein the translating of the image onto the medium is performed as part of a print operation or a scan operation.

5. The method of claim 1, wherein depositing, via the print head of the image translation device, a printing substance onto the medium comprises:

emitting a liquid ink droplet from a nozzle of the print head.

6. The method of claim 1, wherein tracking, via the navigation sensor of the image translation device, the non-linear movement of the image translation device relative to the fixed location on the medium comprises:

tracking a rotational movement of the image translation device relative to the fixed location on the medium.

7. The method of claim 1, wherein tracking, via the navigation sensor of the image translation device, the non-linear movement of the image translation device relative to the fixed location on the medium comprises:

as the image translation device is being moved over the medium to translate the image onto the medium, controlling the navigation sensor to capture a plurality of navigational images, and based on the plurality of navigational images, tracking the non-linear movement of the image translation device relative to the fixed location on the medium.

8. The method of claim 1, wherein tracking, via the navigation sensor of the image translation device, the non-linear movement of the image translation device relative to the fixed location on the medium comprises:

as the image translation device is being moved over the medium to translate the image onto the medium, determining a translation of the navigation sensor within a sensor coordinate system defined by the navigational sensor, transforming the translation within the sensor coordinate system into a translation within a world-space coordinate system, and based on the transforming the translation within the sensor coordinate system into the translation within the world-space coordinate system, tracking the non-linear movement of the image translation device relative to the fixed location on the medium.

9. The method of claim 8, wherein transforming the translation within the sensor coordinate system into the translation within the world-space coordinate system comprises:

as the image translation device is being moved over the medium to translate the image onto the medium, determining a rotation of the navigation sensor within the world-space coordinate system, and based on the determined rotation of the navigation sensor within the world-space coordinate system, transforming the translation within the sensor coordinate system into the translation within the world-space coordinate system.

10. The method of claim 9, wherein the navigation sensor is a first navigation sensor, wherein the sensor coordinate system is a first sensor coordinate system, wherein the image translation device comprises a second navigation sensor that defines a second sensor coordinate system, and wherein determining the rotation of the first navigation sensor within the world-space coordinate system comprises:

determining a difference between the translation of the first navigation sensor within the first sensor coordinate system and a translation of the second navigation sensor within the second sensor coordinate system; and based on determining the difference between the translation of the first navigation sensor within the first sensor coordinate system and the translation of the second navigation sensor within the second sensor coordinate system, determining the rotation of the first navigation sensor within the world-space coordinate system comprises.

11. The method of claim 1, wherein:

a body of the image translation device defines a body coordinate system;

the navigation sensor comprises (i) a light source and (ii) a sensor exposed through an image aperture;

the navigation sensor defines a sensor coordinate system, such that a transverse axis of the sensor coordinate system runs through each of the light source and the image aperture; and the transverse axis of the sensor coordinate system and a transverse axis of the body coordinate system are neither parallel nor perpendicular to each other.

12. An image translation device comprising:

a communication interface configured to receive an image to be translated onto a medium;

a navigation sensor configured to track a non-linear movement of the image translation device relative to a fixed location on the medium, as the image translation device is being moved over the medium to translate the image onto the medium;

a position module configured to determine, based on the tracked non-linear movement of the image translation device relative to the fixed location on the medium, a position of a print head of the image translation device relative to the fixed location on the medium, as the image translation device is being moved over the medium to translate the image onto the medium; and an input/output module configured to determine a portion of the image corresponding to the position of the print head relative to the fixed location on the medium, as the image translation device is being moved over the medium to translate the image onto the medium, wherein the print head is configured to deposit a printing substance onto the medium as the image translation device is being moved over the medium to translate the image onto the medium, wherein the printing substance deposited onto the medium represents the portion of the image corresponding to the position of the print head relative to the fixed location on the medium.

13. The image translation device of claim 12, wherein the image translation device further comprises:

an image processor configured to process the image, prior to translating the image onto the medium.

14. The image translation device of claim 13, wherein the image processor is configured to process the image by performing one or more of dithering, decompression, half-toning, color plane separation, or image storage.

15. The image translation device of claim 12, wherein the translating of the image onto the medium is performed as part of a print operation or a scan operation.

16. The image translation device of claim 12, wherein the print head is configured to deposit the printing substance onto the medium by emitting a liquid ink droplet from a nozzle of the print head.

17. The image translation device of claim 12, wherein the navigation sensor is configured to track the non-linear movement of the image translation device relative to the fixed location on the medium by tracking a rotational movement of the image translation device relative to the fixed location on the medium.

18. The image translation device of claim 12, wherein the navigation sensor is configured to track the non-linear movement of the image translation device relative to the fixed location on the medium by:

as the image translation device is being moved over the medium to translate the image onto the medium, capturing a plurality of navigational images, and based on the plurality of navigational images, tracking the non-linear movement of the image translation device relative to the fixed location on the medium.

19. The image translation device of claim 12, wherein:

a body of the image translation device defines a body coordinate system;

the navigation sensor comprises (i) a light source and (ii) a sensor exposed through an image aperture;

the navigation sensor defines a sensor coordinate system, such that a transverse axis of the sensor coordinate system runs through each of the light source and the image aperture; and the transverse axis of the sensor coordinate system and a transverse axis of the body coordinate system are neither parallel nor perpendicular to each other.

20. The image translation device of claim 19, wherein:

the navigation sensor is a first navigation sensor;

the sensor coordinate system is a first sensor coordinate system;

the image translation device comprises a second navigation sensor that defines a second sensor coordinate system; and a transverse axis of the second sensor coordinate system and the transverse axis of the first sensor coordinate system are neither parallel nor perpendicular to each other.

* * * * *